US007033007B2

(12) United States Patent
Seethoo

(10) Patent No.: US 7,033,007 B2
(45) Date of Patent: Apr. 25, 2006

(54) INKJET PRINTER, INK PUMP MECHANISM AND ACTUATOR

(75) Inventor: Wai Leong Seethoo, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 127 days.

(21) Appl. No.: 10/799,041

(22) Filed: Mar. 11, 2004

(65) Prior Publication Data

US 2005/0200664 A1 Sep. 15, 2005

(51) Int. Cl.
*B41J 2/175* (2006.01)

(52) U.S. Cl. ..... 347/85

(58) Field of Classification Search ..... 347/84, 347/85; 141/2, 18; 222/1, 207, 213, 434, 222/448, 449, 581, 595
See application file for complete search history.

(56) References Cited

U.S. PATENT DOCUMENTS 4,973,993 A * 11/1990 Allen ..... 347/7
4,987,429 A * 1/1991 Finley et al. ..... 347/115
5,136,309 A * 8/1992 Iida et al. ..... 347/7
5,320,250 A * 6/1994 La et al. ..... 222/1
5,721,576 A * 2/1998 Barinaga ..... 347/85
5,856,839 A 1/1999 Aukstikalnis et al.
6,109,740 A * 8/2000 Namekawa et al. ..... 347/85
6,550,899 B1 4/2003 Cowger et al.

* cited by examiner

*Primary Examiner*—Anh T. N. Vo

(57) ABSTRACT

An inkjet printer, utilising at least one ink reservoir having a pump chamber, includes an ink pumping mechanism for pressurising the chamber, the pumping mechanism including an actuator that is biased to pressurise the chamber and that is acted on by a cam to release the pressure. The actuator can include an opening through which the camshaft extends, and the cam can be accommodated within the opening and can engage a cam follower formed on an inner wall of the opening. The bias may be a compression spring mounted in a drop-in manner within a guide element for the actuator. The cam and spring can act directly on the actuator, and a single actuator element can pressurise the chamber, act as a cam follower and include an out-of-ink trigger thereon.

28 Claims, 4 Drawing Sheets

INKJET PRINTER, INK PUMP MECHANISM AND ACTUATOR

FIELD OF THE INVENTION

The present invention relates generally to inkjet printers, and to ink pumping mechanisms and actuators.

BACKGROUND TO THE INVENTION

To print an image, an ink jet printer deposits droplets of ink onto a print medium in a desired pattern. The ink is ejected from the nozzles of one or more printheads of the printer. It may be forced out of the nozzles by the activation of a piezoelectric or thermal element mounted in a firing chamber behind each nozzle. As the ink is ejected from a firing chamber through a nozzle, a vacuum is created in the firing chamber. This draws more ink into the chamber from an associated ink channel to ready the chamber for the next firing.

To operate effectively, the printheads need a reliable supply of ink. A number of ink storage and delivery systems have been devised to achieve this. Some of these systems use permanent ink reservoirs that are refilled by a user, whilst others use replaceable ink cartridges. Some of these replaceable ink cartridges incorporate both a printhead and ink reservoir, whilst others include only the reservoir.

In one example, a cartridge has an ink reservoir and a variable-volume pump chamber that links the reservoir with the printhead so as to provide a controlled ink pressure. An actuator on the printer continually presses against a diaphragm of the cartridge pump chamber to pressurise the ink in the chamber. When the chamber needs to be replenished with ink, the actuator pressure is removed so that the diaphragm can move under the influence of an internal spring to expand the chamber volume and draw ink into the chamber from the reservoir. Once the chamber is refilled, actuator pressure is re-applied to re-pressurise the chamber and allow for further printing.

A prior art actuator arrangement is shown in FIG. 1. The actuator 10 is urged upwardly to pressurise a cartridge pump chamber (not shown) by the force of an extension spring 12 acting through a rocker arm 14 that is mounted on a rocker shaft 16. As ink is supplied to the printhead, the amount of ink in the chamber is reduced, and the actuator 10 moves gradually upwards under the spring force. Once the actuator 10 reaches a set height, corresponding to a chamber refill condition, the rocker arm 14 causes an out-of-ink trip flag 18 to break the beam of an optical switch. This indicates a need to refresh the chamber, and a cam 20 is rotated to act on the rocker arm 14 and oppose the force from the spring 12. This removes the actuator pressure from the cartridge pump chamber and allows ink flow from the reservoir to the chamber. After a preset time, sufficient to allow replenishment of the chamber, the cam 20 is further rotated to allow the actuator 10 to again pressurise the cartridge pump chamber.

Other actuator mechanisms are also known, including those described in U.S. Pat. No. 5,856,839 and U.S. Pat. No. 6,550,899, which again provide an actuator and a cam and rocker arrangement. The contents of U.S. Pat. No. 5,856,839 and U.S. Pat. No. 6,550,899 are incorporated herein by reference.

SUMMARY OF THE INVENTION

It is an object of the present invention to provide a novel ink pumping mechanism for an inkjet printer, which can provide a number of advantages over prior systems.

Briefly, an inkjet printer embodiment of the present invention utilises at least one ink reservoir, ink being supplied from the ink reservoir to a printhead through a pump chamber. The printer includes an ink pumping mechanism for pressurising the pump chamber, e.g. by varying the volume of the chamber, e.g. through the use of a diaphragm, piston or bellows pump. The ink pumping mechanism includes an actuator for pressurising the chamber, and a cam for preventing the actuator from pressurising the chamber. The cam may be mounted on a camshaft that extends through an opening in the actuator, and the cam may be accommodated within the opening and may engage a cam follower defined by a wall portion of the opening.

Other objects and advantages of the present invention will be obvious to those of ordinary skill in the art after having read the following detailed description of preferred embodiments of the present invention, it being understood that the embodiments described are not limiting on the invention, but rather describes possible ways in which the invention may be put into effect.

DETAILED DESCRIPTION OF EMBODIMENTS

Figure 2:
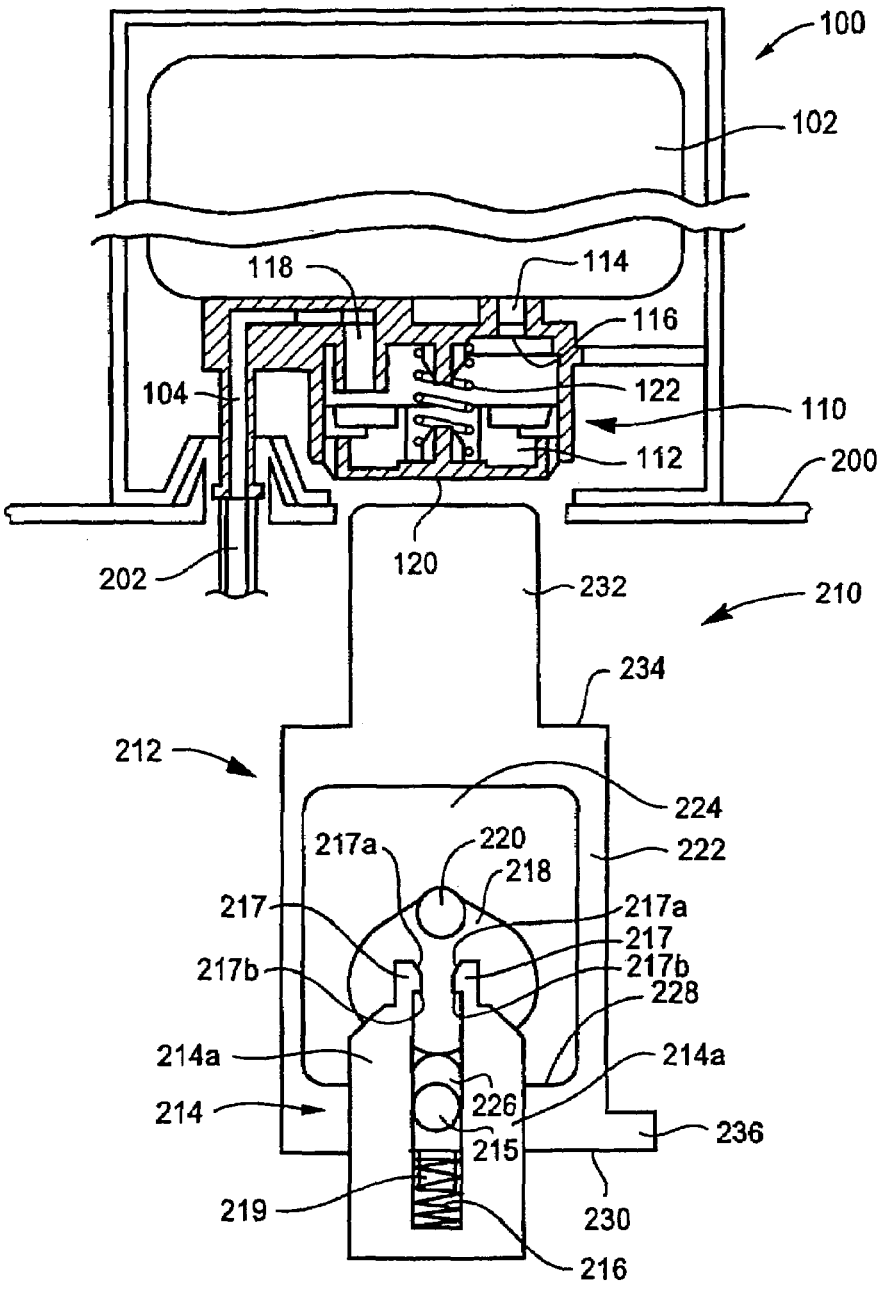
FIG. 2 is a simplified diagram of a cartridge pump chamber and printer actuator mechanism according to one embodiment of the present invention, the actuator mechanism being shown in a non-pressurising position.

In FIG. 2, an ink cartridge 100 having a pump chamber unit 110 is shown mounted on an inkjet printer 200 above a printer pumping mechanism 210. The cartridge 100 and printer 200 includes various other features that would be well understood by a person skilled in the art and that need not be elaborated on here. Also, although only one cartridge and one pumping mechanism are shown, it will be appreciated that a printer many include any required number of cartridges and pumping mechanisms. For example, colour printers often utilise four cartridges, corresponding to black, cyan, magenta and yellow inks.

The pump chamber unit 110 includes a variable volume pump chamber 112 that receives ink from an ink reservoir 102 of the cartridge 100 via a chamber inlet 114 and a one-way valve 116. The pump chamber 112 supplies ink to a cartridge ink outlet 104 via a chamber outlet 118.

When the cartridge 100 is mounted on the printer 200, the cartridge ink outlet 104 couples with a printer ink inlet 202 that in turn communicates with a printhead of the printer 200, e.g. via a tube that trails from a printhead carriage.

A diaphragm 120 is provided in the bottom of the pump chamber 112, and is biased by a chamber spring 122 that urges the diaphragm 120 downwardly to a position that maximises the chamber volume.

As described more fully below, when the cartridge 100 is positioned on the printer 200, the printer pumping mechanism 210 is operated to continually press against the diaphragm 120 during printing. It presses upwardly against the bias of the chamber spring 122 and against the resistance of the ink in the chamber 112. The pumping mechanism 210 thus keeps the ink in the pump chamber 112 at a suitably constant pressure, which enables the ink to be drawn from the pump chamber 112 through chamber outlet 118, cartridge outlet 104 and printer inlet 202 to the firing chambers of the printhead nozzles.

When the cartridge pump chamber 112 reaches an out-of-ink condition, printing is prevented, and the pressure from the pumping mechanism 210 is removed. The diaphragm 120 is then able to move downwardly under the bias of the chamber spring 122 to maximise the volume of the pump chamber 112. This movement causes a reduction in pressure in the pump chamber 112 that draws ink from the cartridge reservoir 102 into the chamber 112. After a preset time, long enough to allow the pump chamber 112 to refill with ink, the printer pumping mechanism 210 reapplies pressure to the diaphragm 120 to allow for further printing.

In the present embodiment, the printer pumping mechanism 210 includes an actuator or slider 212 mounted on a guide 214 for reciprocating movement. The actuator 212 sits within a guide slot of the guide 214, and can be a relatively thin element, e.g. of an elongate generally rectilinear profile.

The guide 214 includes a pair of arms 214*a* on both sides of the actuator 212 for defining the guide slot. Thus, the two arms 214*a* shown in front of the actuator 212 in FIG. 2 are mirrored by another pair of arms 214*a* behind the actuator 212. Each pair of arms 214*a* defines a further guide slot for a projection 215 that extends transversely from the front and rear faces of the actuator 212 to further stabilize the movement of the actuator 212, and also to hold the actuator 212 in place in the guide 214.

The guide arms 214*a* include opposed retaining hooks 217 at their free ends that have inclined upper surfaces 217*a* and flat lower surfaces 217*b*. The actuator 212 can be snapped into place on the guide 214 by pushing down on the actuator 212 so that the projections 215 engage the inclined upper surfaces 217*a* and force the hooks 217 apart to snap the actuator projections 215 into their guide channels. Subsequent removal of the actuator 212 is prevented by engagement of the projections 215 with the flat lower surfaces 217*b* of the hooks 217.

A coiled compression spring 216, as a resilient biasing element, is mounted in the base of the guide 214 to urge the actuator 212 upwardly to engage the pump chamber diaphragm 120 and pressurise the cartridge pump chamber 112. The spring 216 extends over a stem 219 projecting from the base of the actuator 212.

A cam 218 mounted on a camshaft 220 is able to act on the actuator 212 so as oppose the bias of the compression spring 216 and relieve the pressure on the pump chamber 112, thereby allowing the pump chamber 112 to replenish itself.

The actuator 212 includes a body portion 222 that defines an opening 224 therein through which the camshaft 220 extends, and within which the cam 218 is mounted. A cam follower 226 is defined by a portion of an inner wall 228 of the opening 224, and is acted on by the cam 218. The actuator body portion 222 can be seen as a frame element that extends about the cam 218.

The compression spring 216 acts on a lower end 230 of the actuator body portion 222, opposite to the cam follower 224, and the actuator 212 includes a projection 232 for engagement with the diaphragm 120. The projection 232 extends from the end 234 of the body portion 222 that is distal to the compression spring engagement end 230.

In the position shown in FIG. 2, in which the cartridge 100 has newly been placed on the printer 200, the cam 218 engages the cam follower 226 and urges the actuator 212 to its lowest position against the bias of the compression spring 216. The pump chamber 112 is therefore not yet pressurised.

In order to pressurise the chamber 112, the cam 218 is rotated so that the actuator 212 is able to move upwardly under the bias of the compression spring 216. This movement causes the projection 232 to engage the diaphragm 120. At this time, the cam 218 disengages from the cam follower 224, and so the full force of the compression spring 216 acts on the diaphragm 120 through the actuator 212. This causes the diaphragm 120 to flex inwardly, so as to reduce the volume of the pump chamber 112 and so pressurise the pump chamber 112. The cam 218 may be profiled so as to allow the force from the compression spring 216 to be applied gradually to the diaphragm 120.

As ink is lost from the pump chamber 112 to the printhead through printing operations, the diaphragm 120 is depressed gradually inwardly under the bias of the compression spring 216 acting through the actuator 212, so that the pump chamber 112 remains under a constant pressure, within acceptable limits. Thus, when the pump chamber 112 is partially depleted of ink, the diaphragm 120 and actuator 212 will have taken up a position such as is shown in FIG. 3.

Figure 3:
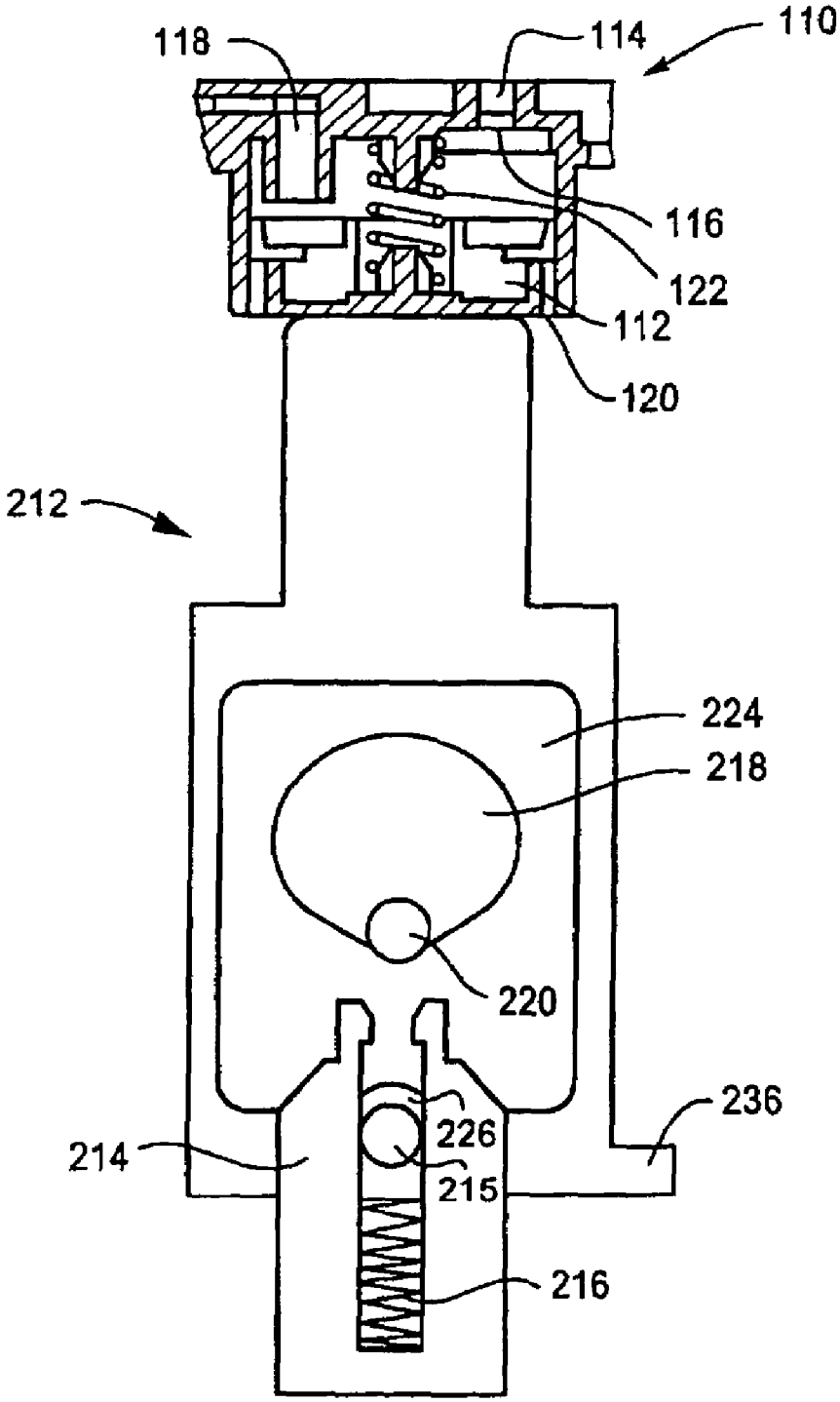
FIG. 3 shows the actuator mechanism of FIG. 2 in an intermediate position in which the actuator is pressing on a diaphragm of the pump chamber in accordance with an embodiment of the present invention.

In FIG. 3, the actuator 212 has gradually moved the diaphragm 120 up into the pump chamber 112 against the bias of the pump spring 122 and the resistance of the ink remaining in the pump chamber 112.

Figure 4:
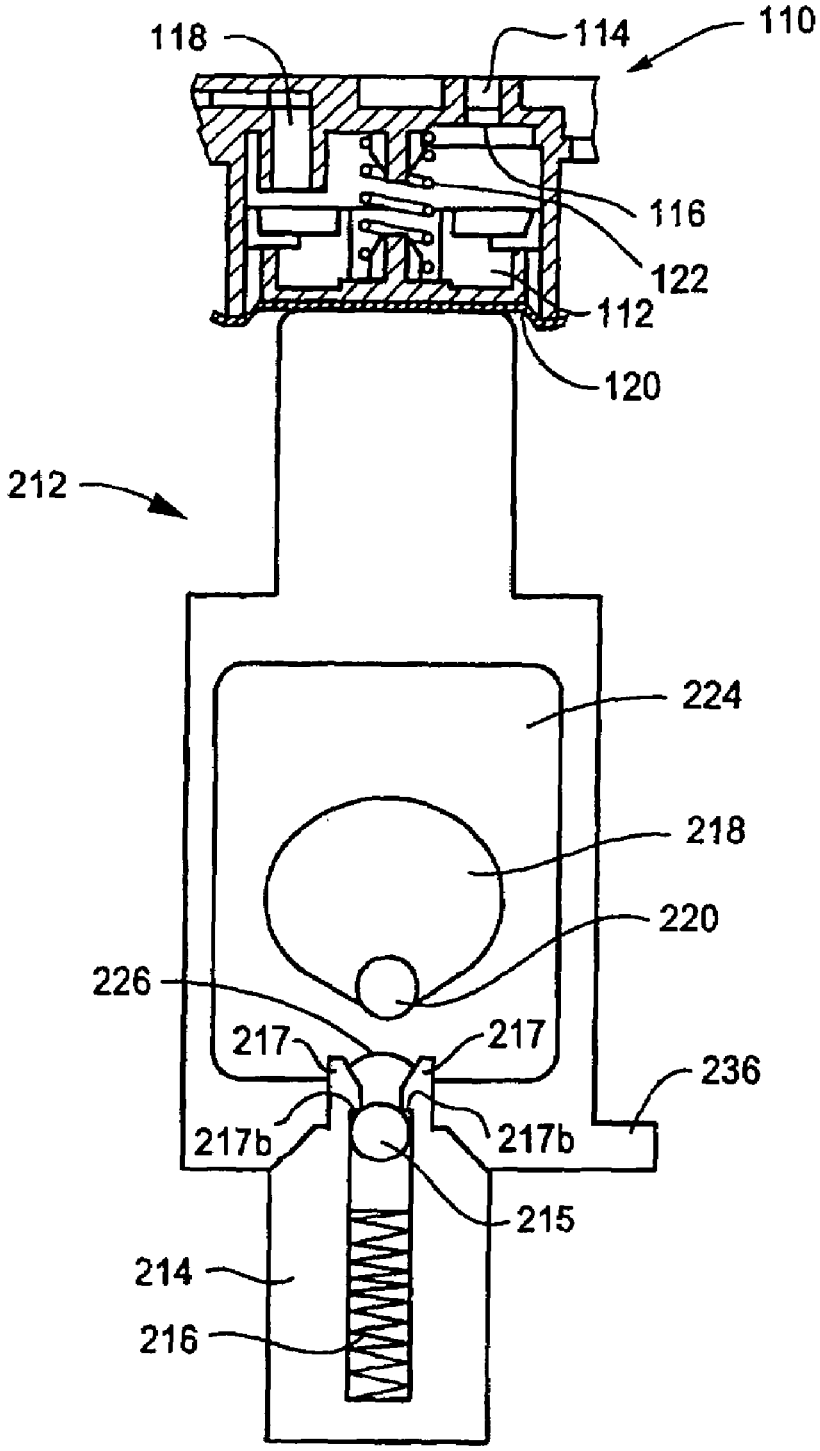
FIG. 4 shows the actuator mechanism of FIG. 2 with the actuator pressing on the diaphragm at a maximum displacement in accordance with an embodiment of the present invention.

Further printing operations and ink depletion results in the actuator 212 forcing the diaphragm 120 further into the pump chamber 112 until the actuator 212 reaches a preset maximum height, as shown in FIG. 4, which corresponds to an out-of-ink condition in which the pump chamber 112 needs to be replenished before printing can continue.

In this position, the actuator projections 215 abut against the flat ends 217*b* of the retaining hooks 217, to prevent accidental movement of the actuator 212 out of the guide 214. Also, as the spring 216 presses the projections 215 against the hooks 217, rattling of the actuator 212 in the guide 214 can be reduced.

The need to replenish the pump chamber 112 is detected by the printer 100 through the use of an out-of-ink trigger 236 that is formed as a tab portion of the actuator 212. Thus, when the actuator 212 is in the preset maximum position, the trigger 236 activates a switch, e.g. by breaking the light beam of an optical switch. Activation of the switch indicates the out-of-ink condition to the printer control system, which e.g. may include suitable hardware, firmware and/or software as appropriate. The control system accordingly rotates the camshaft 220, e.g. through the use of a motor, e.g. a DC electric motor, so that the main lobe of the cam 218 re-engages with the cam follower 226 and forces the actuator 212 downwardly against the bias of the compression spring 216 and out of engagement with the diaphragm 120. The actuator thus returns to the position shown in FIG. 2.

Once the actuator 212 disengages from the diaphragm 120, the chamber spring 122 urges the diaphragm 120 downwardly, so as to expand the pump chamber 112 to its maximum volume, shown in FIG. 2. Ink then flows from the ink reservoir 102 into the pump chamber 112 under the resulting negative pressure.

After a set time, sufficient for the pump chamber 112 to be refilled with ink, the camshaft 220 is again rotated so that the cam 218 disengages from the cam follower 226 to allow the actuator 212 to once again engage the diaphragm 120 under the bias of the compression spring 216, so that the pump chamber 112 is re-pressurised and printing can resume.

The above procedure of continual pressurisation and refilling of the pump chamber 112 can be repeated until the cartridge reservoir 102 is itself fully depleted of ink. Depletion of the reservoir 102 can be determined by the detection of an out-of-ink condition immediately after a pump chamber refill. Thus, after a normal out-of-ink condition and refill of the pump chamber 112, the chamber spring 122 and the resistance of the ink in the chamber 112 will limit the extent to which the actuator 212 can initially rise. However, if there were not enough ink in the reservoir 102 to adequately refill the pump chamber 112, the actuator 212 would be able to rise to the out-of-ink position immediately after the attempted refill. The short time period between the two out-of-ink conditions would be detected by the printer control system. The control system can then initiate a suitable empty cartridge procedure, e.g. light an "out-of-ink" LED on the printer control panel.

As mentioned above, the printer 200 may include a number of the cartridges 100 and pumping mechanisms 210. In this case, the actuators of the pumping mechanisms may be acted on by cams 218 that are mounted on the same camshaft 220. Thus, all of the cartridge chambers 120 will be refilled at the same time, when at least one of the chambers 120 reaches its minimum operational ink volume.

If desired, the printer control system may also operate the camshaft 220 so that the actuators 212 do not pressurise the pump chambers 112 during non-printing periods. Separate camshafts may be provided for one or more of the cartridges, e.g. to split the control of black and colour cartridges.

The printer pump mechanism described has a number of distinctive features and advantages.

The cam in the present embodiment can act directly on the actuator rather than through a rocker arm, and further can be provided within the actuator. Also, the pressurising force can be provided by a compression spring, that itself acts directly on the actuator. The actuator in this design can function as the pump actuator itself, as a cam follower, and as an out-of-ink sensor trigger.

The described mechanism can reduce the number of parts used. Thus, for a four colour ink supply station, a prior art system might typically use twenty-two parts comprising four actuators, four rockers, four extension springs, four out-of-ink trip flags, four adjustment screws for the flags, a camshaft and a rocker shaft. This can result in relatively long assembly times, and the large number of parts creates large numbers of critical dimensions that can be expensive and difficult to maintain.

The present embodiment may instead use only ten parts, e.g. four actuators 212, four compression springs 216, a single guide member that provides all of the guides 214, and a camshaft 220 (with cams 218 thereon). This can therefore reduce costs and assembly time.

Figure 1:
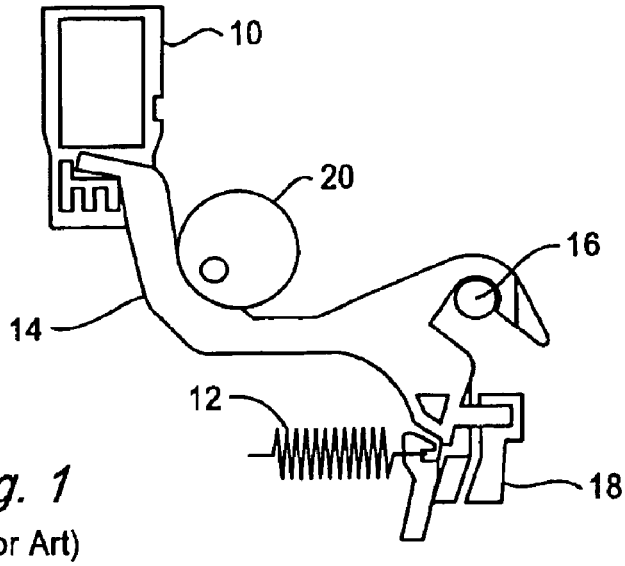
Fig. 1 (Prior Art)
FIG. 1 is a diagram of a prior art pump actuator.

Assembly time can also be reduced due to the use of a compression spring 216 rather than the extension spring of FIG. 1, and further through the placement of the spring 216 in the guide 214, so as to allow for a simple drop-in installation of the spring 216 into the base of the guide 214. Thus, the spring 216 can be placed into the base of the guide 216 or on the actuator stem 219, and then the actuator 212 can be fitted into the guide 214, e.g. as a snap-fit. The spring 216 is thus held in place during manufacture between the guide 214 and actuator 212.

In contrast, the prior art of FIG. 1 requires manipulation and hooking of the extension spring 12 between the chassis of the printer and the rocker 14, the operator having to exert a force against the spring 12 whilst doing this.

The present embodiment allows for a simple snap-in assembly for the actuator 212. Also, the present embodiment is compact in design, with the actuator spring force, the cam force and actuator movement applied along the same line of action, and with the spring, cam, actuator and chamber aligned in a straight line.

The system is able to accurately indicate an out-of-ink condition without the tolerance difficulties found in the prior art. Thus, in the FIG. 1 prior art, the large number of parts that translate the force of the spring 12 to the actuator 10 results in a large tolerance stack. This made it necessary to provide independent adjustment of the trip flag 18 so that it could accurately reflect the actuator height. The system thus used a self-tapping screw to provide the adjustment, which increased assembly time, and was also problematic because the thread of the plastic screw could wear after a couple of adjustment attempts and would then need to be discarded.

The present embodiment in contrast mounts the out-of-ink trigger 236 on the actuator itself, and indeed the trigger may, as in the present embodiment, be an integral part of the actuator. The system thus removes the tolerance stack, and the trigger can accurately reflect actuator position without adjustment. Accuracy is further facilitated by the movement of the actuator and trigger in a straight line, the actuator being linearly displaced during its stroke.

In the present embodiment, the various parts can be moulded to the correct specification rather than requiring time-consuming manual adjustment to provide the correct specification. The actuator 212 itself can be a single, e.g. plastics, moulded part. It can be a one-piece lifter that includes a pump chamber engagement portion, a cam follower and an out-of-ink trigger.

Figure 5:
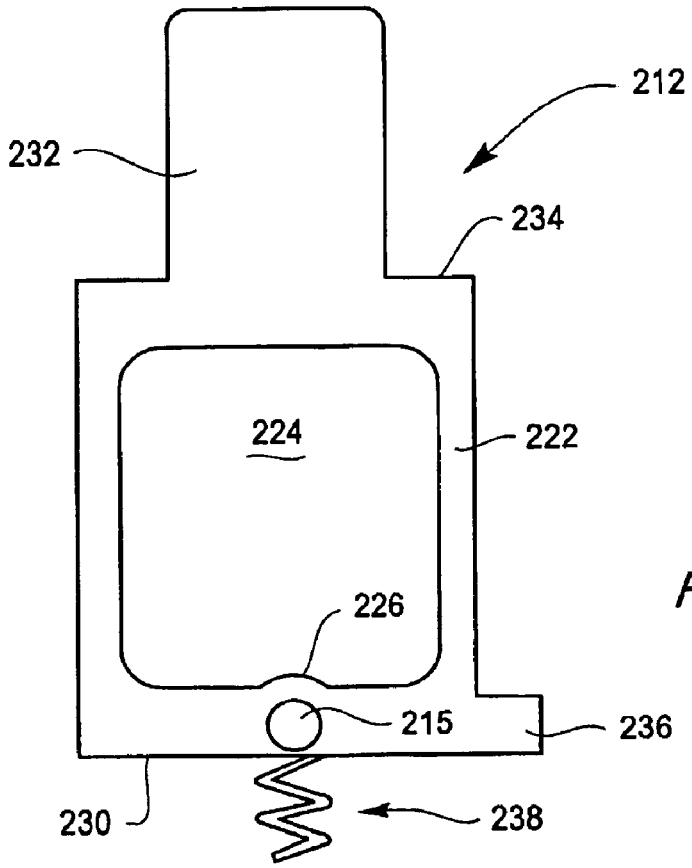
FIG. 5 shows an actuator according to another embodiment of the present invention.

Further, the actuator 212 may also include an integral biasing element, e.g. spring, which can further reduce the number of parts and simply construction. Thus, as shown in FIG. 5, in another embodiment, the actuator 212 is moulded to have a spring element 238 extend from its base 230. The spring element 238 may for example take on a zig-zag form.

Various alternative embodiments are also possible to those mentioned above. For example, the pump chamber could be provided on the printer rather than on the ink cartridge. Also, the ink reservoir could be a permanent reservoir, rather than provided in a removable cartridge. The pump chamber might take a different form, and could include a piston rather than a diaphragm or could comprise a bellows arrangement, e.g. as shown in FIG. 8 of U.S. Pat. No. 6,550,899.

The coiled compression spring could be replaced by any other suitable type of compression spring including for example a leaf spring. It could also take the form of or be replaced by any other suitable type of biasing element in general, e.g. the compression spring could be replaced by an extension spring or springs, whilst still retaining various advantages for the system.

The trigger 236 could move to allow a beam to pass rather than break a beam, and the trigger could take on a different form and, e.g. be differently positioned. A trigger beam or other switch could for example be positioned so that it is triggered by a portion of the actuator that is adjacent the periphery of the opening 224. Instead of an optical switch, any other suitable switch could be used, e.g. a mechanical or capacitive switch.

Instead of mounting the cam in the actuator opening, the cam could be adjacent the actuator body, and could act on a cam follower formed from a flange extending from the side of the actuator body.

The various parts shown could also take many different shapes, and for example the cam could take a number of different forms. For example, although the cam takes a full half-turn to release the actuator in the described example, it could be profiled to require only a quarter turn or the like. The actuator and guide could also take on other forms.

Thus, whilst an embodiment of the present invention has been illustrated here in detail, it will be understood that modifications and adaptations to the embodiment may be made by one skilled in the art without departing from the scope of the present invention, and that the scope of the present invention is as set forth in the following claims. Accordingly, it is intended that the appended claims be interpreted as covering all alterations and modifications as fall within the spirit and scope of the present invention.

What is claimed is:

1. An inkjet printer utilising at least one ink reservoir, ink being supplied from the ink reservoir through a pump chamber, the printer including an ink pumping mechanism for pressurizing the pump chamber, the ink pumping mechanism including:

an actuator for acting on said chamber to pressurize said chamber; and a cam for placing said actuator in a non-pressurizing position wherein the actuator includes a body portion having an opening therein through which a camshaft of said cam extends.

2. The printer of claim 1, wherein:

said cam is accommodated within said opening.

3. The printer of claim 2, wherein:

said actuator includes a cam follower defined by an inner wall of said opening, said cam acting on said cam follower to move said actuator into said non-pressurizing position.

4. The printer of claim 1 further including:

a biasing element, said actuator being urged to pressurize said chamber by said biasing element.

5. The printer of claim 4, wherein:

wherein said biasing element is a compression spring.

6. The printer of claim 5, wherein said compression spring is a coiled compression spring.

7. The printer of claim 4, wherein said biasing element is integral with said actuator.

8. The printer of claim 1 further including:

a guide element, said actuator being mounted on said guide element for reciprocating movement therealong.

9. The printer of claim 8, wherein:

the actuator includes front and rear faces, each with a projection extending outwardly therefrom, and wherein:

said guide element includes a pair of guide arms adjacent each face of said actuator, each pair of arms defining a guide slot along which a said projection runs in use.

10. The printer of claim 4, further including a guide element, said actuator being mounted on said guide element for reciprocating movement therealong, and wherein said biasing element is mounted within said guide element in a drop-in manner.

11. The printer of claim 1, wherein said pump chamber includes a diaphragm for varying the volume of said chamber, and said actuator acts on said diaphragm to pressurize said chamber.

12. The printer of claim 1 further including:

an out-of-ink switch and a trigger element on said actuator for triggering said out-of-ink switch when said actuator has moved to a predetermined position.

13. The printer of claim 12, wherein said trigger element is an integral part of said actuator.

14. The printer of claim 1, wherein said ink reservoir is provided in a replaceable cartridge.

15. The printer of claim 1, further including a biasing element that acts on said actuator to pressurize said chamber, wherein said biasing element, said cam and said actuator are positioned so as to be aligned with one another and with said chamber in a straight line.

16. The printer of claim 1, further including a biasing element that acts on said actuator to pressurize said chamber, said actuator being mounted in a guide element for reciprocal motion therealong and said biasing element being mounted between said guide element and an end of said actuator distal from said pump chamber.

17. The printer of claim 1, further including a biasing element that acts on said actuator to pressurize said chamber, said biasing element and said cam acting directly on said actuator.

18. The printer of claim 1, further including a spring member for causing said actuator to pressurize said chamber, wherein said actuator moves in a reciprocating manner, and wherein said spring member acts on an end of said actuator that is distal from an end of said actuator that engages said pump chamber.

19. A method of supplying ink from an ink reservoir of an inkjet printer through a pump chamber, the method including:

providing an actuator to pressurize said chamber, providing a biasing element to bias said actuator to pressurize said pump chamber;

accommodating a cam on a camshaft that extends through an opening in said actuator, and rotating said cam to act on said actuator against said biasing element, so as to remove pressure from said pump chamber when said chamber is in need of refilling by said ink reservoir.

20. An ink pumping mechanism for pressurising a pump chamber associated with an ink reservoir of an inkjet printer, said ink pumping mechanism including:

an actuator for pressurizing said pump chamber; and a cam to move said actuator into a position in which said actuator does not pressurize said chamber;

wherein said actuator includes a body portion having an opening therein through which a camshaft of said cam extends.

21. The ink pumping mechanism of claim 20, wherein said opening has an inner surface on which is provided a cam follower, said cam engaging said cam follower to move said actuator.

22. An actuator for an ink pump mechanism of an inkjet printer, the printer having an ink reservoir and pump chamber that is pressurized by the ink pump mechanism, said actuator including:

a body portion defining an opening therein for accommodating a camshaft of a cam;

an end portion on which a biasing element acts for biasing said actuator to pressurise said chamber; and a projection, distal from said end portion, for engaging said diaphragm.

23. The actuator of claim 22, wherein said opening has an inner surface on which is provided a cam follower, said cam engaging said cam follower to move said actuator.

24. A method of making an inkjet printer having an ink pump mechanism for pressurizing a pump chamber of an ink reservoir, the method including:

providing an actuator for acting on said pump chamber in order to pressurize said chamber;

providing a biasing element that acts directly on said actuator to urge said actuator to depress said diaphragm; and providing a cam for acting on said actuator to oppose said biasing element, said cam being mounted on a camshaft that extends through said actuator.

25. The method of claim 24, wherein said biasing element is provided as a compression spring that acts on said actuator on an end thereof distal from said pump.

26. The method of claim 25 further including:

mounting said actuator on a guide element for reciprocating movement therealong, said biasing element being mounted within said guide element prior to the mounting of said actuator on said guide element.

27. The method of claim 24 wherein said biasing element is provided by integrally moulding said biasing element as part of said actuator.

28. An inkjet printer utilising at least one ink reservoir, ink being supplied from said reservoir to a printhead through a variable-volume pump chamber, the printer including an ink pumping mechanism for pressurizing said pump chamber, said ink pumping mechanism including:

a slider for acting on said pump chamber;

a guide on which said slider is mounted for linear movement;

a compression spring mounted on said guide for biasing said slider to a position in which it pressurizes said chamber;

and a cam for moving said slider to a position in which it does not pressurize said chamber, said slider defining an opening therein within which said cam is accommodated and including a cam follower with which said cam engages to move said slider.

* * * * *